US009534369B2

(12) United States Patent
Rhee et al.

(10) Patent No.: US 9,534,369 B2
(45) Date of Patent: Jan. 3, 2017

(54) INLET OF UNDERGROUND RESERVOIR HAVING MULTIPLE-STAGE STRUCTURE

(71) Applicant: KOREA INSTITUTE OF CONSTRUCTION TECHNOLOGY, Goyang-si Gyeonggi-do (KR)

(72) Inventors: Dong Sop Rhee, Paju-si (KR); Gil Je Cho, Miryang-si (KR); Du Han Lee, Goyang-si (KR); Seung Yong Hwang, Goyang-si (KR); Myoung Hwan Kim, Bucheon-si (KR)

(73) Assignee: Korea Institute of Construction Technology, Goyang-si, Gyeonggi-do (KR)

( * ) Notice: Subject to any disclaimer, the term of this patent is extended or adjusted under 35 U.S.C. 154(b) by 0 days.

(21) Appl. No.: 14/492,159

(22) Filed: Sep. 22, 2014

(65) Prior Publication Data

US 2015/0093198 A1 Apr. 2, 2015

(51) Int. Cl.
*E03F 1/00* (2006.01)
*E03F 5/10* (2006.01)

(52) U.S. Cl.
CPC ..... *E03F 5/106* (2013.01)

(58) Field of Classification Search
CPC ..... E03F 1/00; E03F 1/005; E03F 5/0407; E02B 11/005; C02F 1/00; C02F 2103/001; C02F 2301/026; F15C 1/16; F15D 1/0015; F15D 1/04; F15D 1/02; F15D 1/001
USPC ..... 405/39, 40, 41, 43; 137/808, 809, 810, 137/811; 239/17, 20, 127
See application file for complete search history.

(56) References Cited

U.S. PATENT DOCUMENTS 2,527,046 A * 10/1950 Wold ..... E02B 13/00 405/40
2,910,830 A * 11/1959 White ..... F02C 7/04 137/810
3,207,168 A * 9/1965 Warren ..... F15C 1/02 137/809
3,209,774 A * 10/1965 Manion ..... F15C 1/16 116/137 A
3,216,439 A * 11/1965 Manion ..... F15C 1/16 137/810
3,396,738 A * 8/1968 Gunnar ..... F04D 29/681 137/13
3,608,573 A * 9/1971 Bahrton ..... F15C 1/08 137/811
3,679,242 A * 7/1972 Hess ..... 285/417
6,382,520 B1 * 5/2002 Hones ..... A63H 18/02 238/10 F
7,931,719 B2 * 4/2011 Sams et al. ..... 55/348
(Continued)

FOREIGN PATENT DOCUMENTS

CN 103243693 A * 8/2013

*Primary Examiner* — Benjamin Fiorello
*Assistant Examiner* — Edwin Toledo-Duran
(74) *Attorney, Agent, or Firm* — Novick, Kim & Lee, PLLC; Jae Youn Kim

(57) ABSTRACT

According to one aspect of the invention, an inlet of an underground reservoir having a multiple-stage structure includes: a flow portion, wherein water flowing in the flow portions; a drop portion transporting the water to a underground reservoir from the flow portion; and an inlet portion having a multiple-stage structure to generate a vortex in the water to be transported to the drop portion.

5 Claims, 4 Drawing Sheets

(56) References Cited

U.S. PATENT DOCUMENTS

| | | | | |
|---|---|---|---|---|
| 8,291,976 | B2 * | 10/2012 | Schultz | E21B 43/12 137/811 |
| 2007/0028977 | A1 * | 2/2007 | Goulet | F15C 1/16 137/809 |
| 2008/0035226 | A1 * | 2/2008 | Conrad | B01F 3/0446 137/808 |
| 2008/0078446 | A1 * | 4/2008 | Fujiwara | B01F 13/0062 137/3 |
| 2008/0121299 | A1 * | 5/2008 | Shiraishi | G21C 15/18 137/810 |
| 2009/0226301 | A1 * | 9/2009 | Priestman | F15C 1/02 415/145 |
| 2012/0073691 | A1 * | 3/2012 | Davis et al. | 137/808 |
| 2012/0227813 | A1 * | 9/2012 | Meek | B01D 17/0217 137/1 |

* cited by examiner

INLET OF UNDERGROUND RESERVOIR HAVING MULTIPLE-STAGE STRUCTURE

CROSS-REFERENCE TO RELATED APPLICATION

This application claims the priority benefit of Korean Patent Application No. 10-2013-0116085, filed on Sep. 30, 2013 in the Korean Intellectual Property Office, the disclosure of which is incorporated herein by reference.

BACKGROUND OF THE INVENTION

1. Field of the invention

The present invention relates to an inlet of an underground reservoir, and more particularly, to an inlet of an underground reservoir for generating a vortex in a flux (a rate of flow) lower than a design flow.

2. Description of the Related Art

Generally, inlets for flowing rain to an underground reservoir after the rain are formed at conventional drains or drainage holes of road sides.

The inlets are classified into a tangential intake structure and a spiral intake structure that are usually used for the inlets. In the inlet having the tangential intake structure, an installation space is a small and the installation process is simple when it is installed. In the inlet having the spiral intake structure, a spiral structure is formed from an inlet portion to a shaft (a vertical shaft or a mineshaft) to form a vortex inside the inlet. And thus, the vortex flow is naturally generated in the inlet having the spiral intake structure.

However, when a flux flowing into the inlet, which is for guiding the water such as rain to a conventional underground reservoir, is lower than a design flux, the vortex flow is not sufficiently formed inside the inlet. Therefore, an original function of the inlet cannot be achieved.

When the vortex flow inside the inlet does not generate, since energy of the flow does not dissipate, various problems such as damage, breakage, and so on of a structure are caused.

SUMMARY OF THE INVENTION

The present invention has been made in view of the above problems, and the present invention provides an inlet of an underground reservoir being able to generate a vortex and stably maintain a discharging efficiency in even a low flux.

According to one aspect of the invention, an inlet of an underground reservoir having a multiple-stage structure includes: a flow portion, wherein water flowing in the flow portions; a drop portion transporting the water to a underground reservoir from the flow portion; and an inlet portion having a multiple-stage structure to generate a vortex in the water to be transported to the drop portion.

The flow portion may be located at a more elevated position than the drop portion so that the water flows to the drop portion.

The flow portion may include a plurality of protrusions at a bottom of the flow portion to control a flow velocity of the water.

The inlet portion may include a plurality of multiple-stage boards. The plurality of multiple-stage boards may include at least one horizontal plane and at least one vertical plane. The horizontal plane may protrude from one side surface of the flow portion to another side of the flow portion. The vertical plane may be downwardly formed from the horizontal plane to be perpendicular to the ground.

The plurality of the multiple-stage boards may be inclined from the flow portion to the drop portion.

The drop portion may have a cylinder shape to generate a vortex flow in the water inflowing through the multiple-stage boards.

The drop portion further may include a spiral protrusion having a spiral shape to maintain the vortex of the water when the water flows into the underground reservoir.

According to an inlet of an underground reservoir according to an embodiment of the present invention, by multiple-stage boards formed at an inlet portion to form a multiple-stage structure, a vortex of water can be generated in even a low flux.

DETAILED DESCRIPTION OF THE EMBODIMENTS

Hereinafter, with reference to accompanying drawings, an inlet of an underground reservoir according to an embodiment of the present invention will be described in detail.

Figure 1:
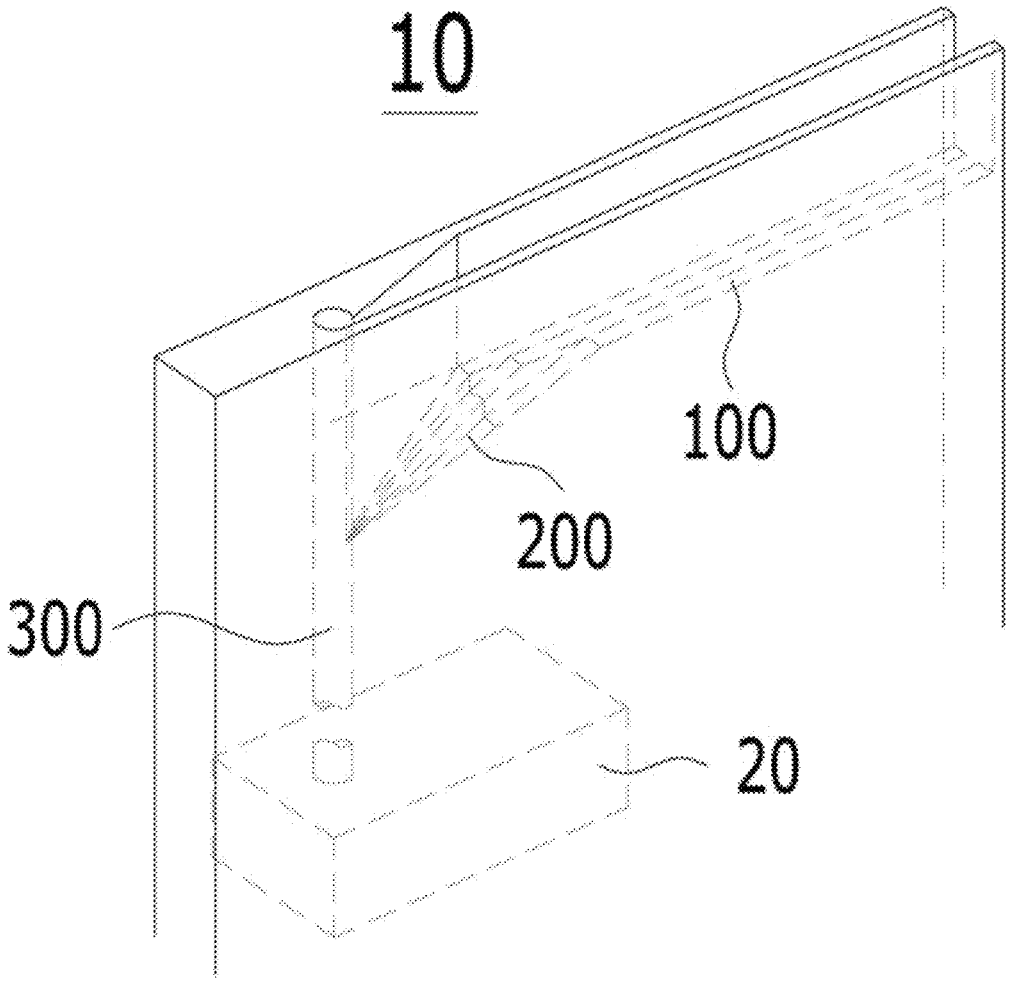
FIG. 1 is a perspective view for illustrating an inlet of an underground reservoir according to an embodiment of the present invention.
Figure 2:
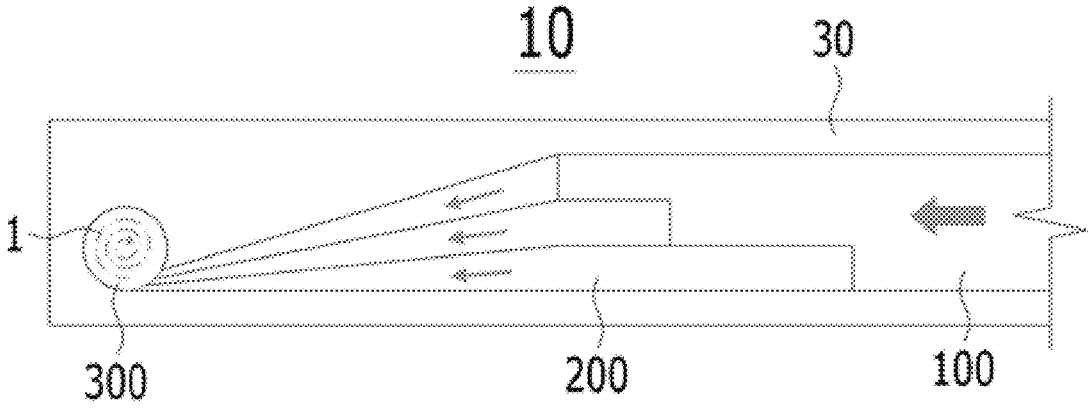
FIG. 2 is a plan view for illustrating the inlet of the underground reservoir shown in FIG. 1.

FIG. 1 is a perspective view for illustrating an inlet of an underground reservoir according to an embodiment of the present invention, and FIG. 2 is a plan view for illustrating the inlet of the underground reservoir shown in FIG. 1.

As shown in FIG. 1 and FIG. 2, an inlet 10 of an underground reservoir 20 having a multiple-stage structure according to an embodiment includes a flow portion 100 where water 1 flows in or through the flow portion 100, a drop portion 300 for transporting the water 1 to the underground reservoir 20, and an inlet portion 200 having a multiple-stage structure to generate a vortex of the water 1.

When the rainfall or the water 1 flows into an under passageway, such as a tunnel, an underground road way, and so on, formed at low altitude and then flows into a detention pond or the underground reservoir 20 installed under the ground, the inlet 10 of the underground reservoir 20 generates the vortex and act as a passage or a path of the rainfall or the water 1 so that the rainfall or the water 1 can flow into the underground reservoir 20. Also, when the water 1 flows into the inlet 10 of the underground reservoirs 20 through an agricultural waterway, the inlet 10 of the underground reservoir 20 generates the vortex and transports the water 1 downwardly.

The inlet 10 of the underground reservoir 20 may include the flow portion 100, the drop portion 300, and the inlet portion 200. The flow portion 100 is connected to the under passageway and the water 1 such as the rainfall in the rain flows in the flow portion 100. The drop portion 300 transports the water 1 from the flow portion 100 to the underground reservoir 20. The inlet portion 200 has the multiple-stage structure to form the vortex of the water 1 transported to the drop portion 300.

The flow portion 100 may be connected to the under passageway so that the water 1 such as the rainfall in the rain can be flow into the underground reservoir 20. At the flow portion 100, a side wall (or a plurality of side walls, for example, two side walls) 30 for guiding the water 1 may be formed so that the water 1 can flow into the underground reservoir 20 through the flow portion 100. The side wall 30 has a predetermined height to prevent the water 1 from spilling over in the rain. Also, the flow portion 100 may be located at a more elevated position than the drop portion 300 so that the water 1 can flow into the drop portion 300. Accordingly, the water 1 flowing in the flow portion 100 can flow into the drop portion 300. In addition, the flow portion 100 may be inclined by a predetermined angle so that the water 1 of even a low flux can flow into the drop portion 300 in the rain. Thus, the water 1 can flow in the flow portion 100.

The drop portion 300 is perpendicularly formed (to the ground) so that the water 1 flowing in the flow portion 100 can penetrate the inlet portion 200 and can flow into the underground reservoir 20. The drop portion 300 may have a cylinder shape, and thus, the water 1 flowing into the drop portion 300 through the flow portion 100 drops downwardly with the vortex generated in the water 1. Because the water 1 flowing into the underground reservoir 20 through the drop portion 300 drops downwardly while generating the vortex, the energy of the flow can dissipate even when the water 1 of the low flux inflows.

The inlet portion 200 has a multiple-stage structure to generate the vortex when the water 1 of the drop portion 300, which is transported from the flow portion 100 to the drop portion 300, is transported downwardly and when the water 1 is transported to the underground reservoir 20. Also, the inlet portion 200 has a slope way from the flow portion 100 located at the elevated position to the drop portion 300 so that the water 1 of the low flux, which is transported from the flow portion 100 to the drop portion 300, can be smoothly transported.

Further, a width of the inlet portion 200 (when it is viewed in a plan view) may gradually decrease from an end of the flow portion 100 toward the drop portion 300. The width of the inlet portion 200 decreases as it goes from one end of the inlet portion 200 adjacent to (or near) the flow portion 100 to the other end of the inlet portion 200 adjacent to (or near) the drop portion 300.

Figure 3:
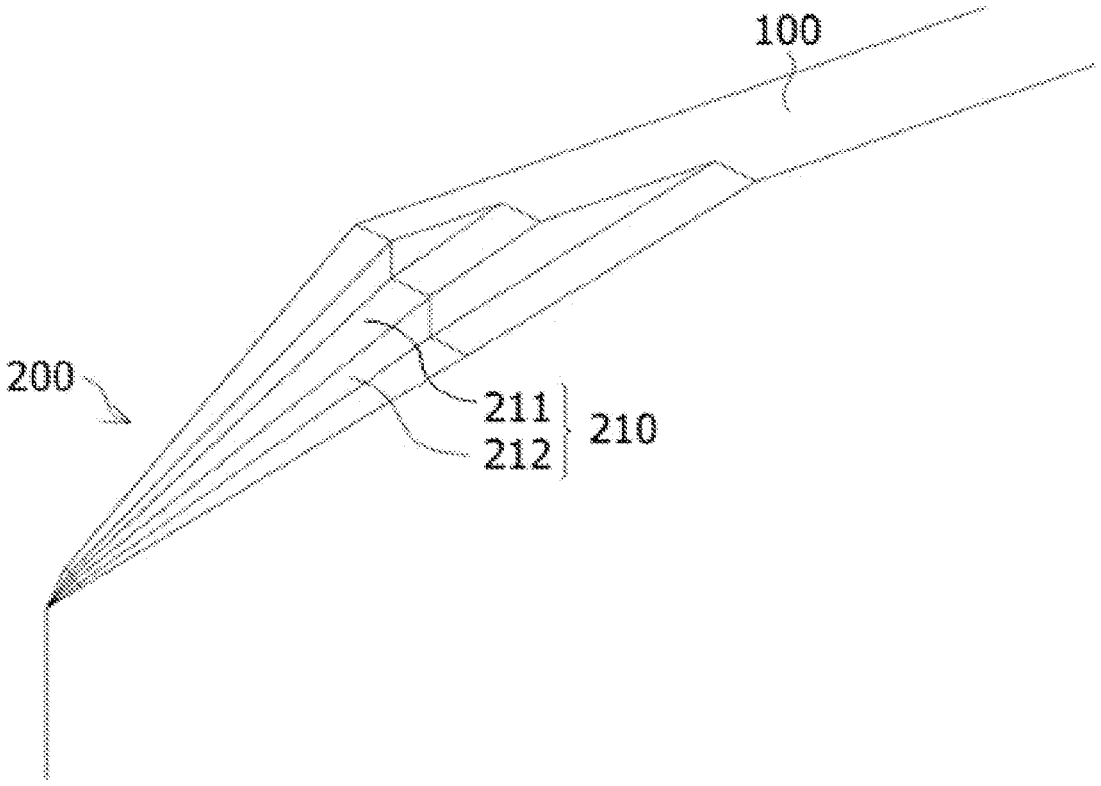
FIG. 3 is a perspective view of an inlet portion according to an embodiment of the present invention.

FIG. 3 is a perspective view of the inlet portion according to an embodiment of the present invention.

As shown in FIG. 3, the inlet portion 200 of the inlet 10 of the underground reservoir 20 according to an embodiment of the present invention can generate the vortex of the water 1 transported from an upper portion to a lower portion.

The inlet portion 200 may be formed to be inclined from the one end of the inlet portion 200 adjacent to (or near) the flow portion 100 to the other end of the inlet portion 200 adjacent to (or near) the drop portion 300 so that the flow of the water 1 can be smooth when the water 1 flows from the flow portion 100 to the drop portion 300 in the rain.

Also, the width of the inlet portion 200 decreases as it goes from the one end of the inlet portion 200 adjacent to (or near) the flow portion 100 to the other end of the inlet portion 200 adjacent to (or near) the drop portion 300. Accordingly, the vortex can be generated.

The inlet portion 200 may include a plurality of multiple-stage boards 210. The multiple-stage boards 210 may include at least one horizontal plane 211 and at least one vertical plane 212. The horizontal plane 211 horizontally protrudes from one side surface of the flow portion 100 to another side of the flow portion 100. The vertical plane 212 is formed downwardly from the horizontal plane 211 to be perpendicular to the ground. The multiple-stage boards 210 form a step shape from one side wall 30 to the other side wall 30. As described in the above, the side walls 30 are for preventing the water 1 of the inlet 10 of the underground reservoir 20 from spilling over.

Also, the multiple-stage boards 210 slantly or slopingly form the step shape to generate the vortex of the water 1. The multiple-stage boards 210 are formed to be inclined between the flow portion 100 and the drop portion 300. As described in the above, the multiple-stage boards 210 may include the horizontal planes 211 and the vertical planes 212. The horizontal planes 211 are formed at both of the side walls 30 of the inlet 10 of the underground reservoir 20, which act as guide walls for preventing the water 1 from spilling over or being transported to the outside and for controlling the flow of the water 1. The horizontal planes 211 are inclined in a direction from the flow portion 100 and the drop portion 300, and are parallel between the both of the side walls 30. Here, the phrase "the horizontal planes 211 are parallel between the both of the side walls" means that a first point of an edge of the horizontal plane 211 adjacent to one side wall 30 and a second point of the other edge of the horizontal plane 211, which is opposite to the first point, have the same vertical positions. The vertical planes 212 are downwardly formed from the horizontal plane 211 to be perpendicular (to the ground) so that the water 1 can flow downwardly.

The horizontal planes 211 and the vertical planes 212 are inclined from the flow portion 100 to the drop portion 300. Also, the horizontal plane 211 and the vertical plane 212 form the step shape at the end of the flow portion 100. The water 1 inflowing through the flow portion 100 flows to be inclined stage by stage into the drop portion 300.

Therefore, the vortex can generates in the water 1 flowing into the drop portion through the flow portion 100. Thus, even in the low flux, the energy of the flow can stably dissipate and a discharging efficiency can be maintained.

For example, if the inlet portion 200 does not have the multiple-stage structure, the water 1 flowing from the flow portion 100 to the drop portion 300 may quickly flow by inclined surfaces of the inlet portion 200. Then, the drop portion 300 may be damaged or broken. On the other hand, when the inlet portion 200 has the multiple-stage boards 210 of the multiple-stage structure, the water 1 flowing from the flow portion 100 into the drop portion 300 can inflow into the drop portion 300 in the state that the water 1 is flocked or concentrated to one side. Thus, the vortex can generate, the energy of the flow can dissipate by the vortex, and a structure can be prevented from being damaged or broken.

A size, a number, and/or a material of the multiple-stage boards 210 of the inlet portion 200 may be varied depending on regional characters.

Hereinafter, an inlet of an underground reservoir according to another embodiment of the invention will be described. For convenience, same reference numerals refer to same or similar elements throughout. The portions the same as or similar to the portions of the above embodiment will be omitted.

Figure 4:
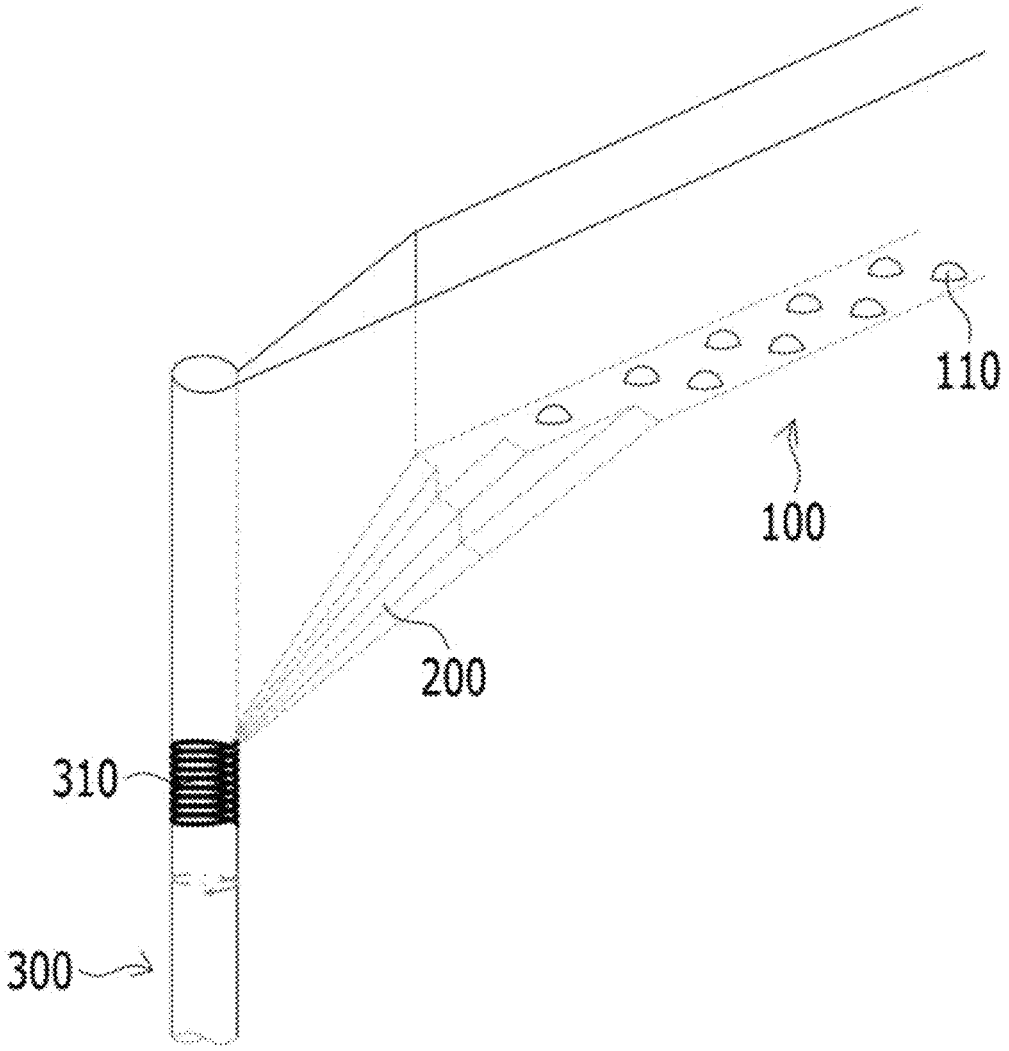
FIG. 4 is a perspective view for illustrating an inlet of an underground reservoir according to another embodiment of the present invention.

FIG. 4 is a perspective view for illustrating an inlet of an underground reservoir according to another embodiment of the present invention.

As shown in FIG. 4, an inlet 10 of an underground reservoir 20 having a multiple-stage structure according to an embodiment includes a flow portion 100 where water 1 flows in the flow portion 100, a drop portion 300 for transporting the water 1 to the underground reservoir 20, and an inlet portion 200 having a multiple-stage structure to generate a vortex of the water 1.

The flow portion 100 may act as a passage or a path where the water 1 of an agricultural waterway and sewage flows in the rain. The flow portion 100 may be located at a more elevated position than the drop portion 300 so that the water 1 can flow into the drop portion 300. In addition, the flow portion 100 may be inclined by a predetermined angle toward the drop portion 300 so that the water can smoothly flow to the drop portion 300.

Also, the flow portion 100 may include a plurality of protrusions 111 at a bottom of the flow portion 100 to control a flow velocity of the water 1. The protractions 111 control the flow velocity of the water 1 and prevent foreign substances from being stacked to the flow portion 100.

For example, if the flow portion 100 does not include the plurality of protrusions 111 at the bottom of the flow portion 100, the flow velocity is high when the flux increases. Then, when the water 1 flows into the drop portion 300, a structure may be damaged or broken by the energy of the flow. Therefore, in the present embodiment, by including the plurality of protrusions 111 at the bottom of the flow portion 100, the protrusions 111 act as obstacles to prevent the increases of the flow velocity of the water 1, thereby increasing resistance. Also, by including the plurality of protrusions 111 at the bottom of the flow portion 100, foreign substances are not in contact with the bottom and can float between the protrusions 111. Thus, the foreign substances can transported to the drop portion 300 by the flow velocity. Further, the foreign substances of small particles, like soil, that can permeate between the protrusions 111 can be eliminated through the vortex generated by the protrusions 111.

As described in the above, the inlet portion 200 may include a plurality of multiple-stage boards 210. The multiple-stage boards 210 may include at least one horizontal plane 211 and at least one vertical plane 212. The horizontal plane 211 horizontally protrudes from one side wall 30 of the flow portion 100 to another side wall 30 of the flow portion 100. The vertical plane 212 is formed downwardly from the horizontal plane 211 to be perpendicular to the ground. The multiple-stage boards 210 form a step shape from one side wall 30 to the other side wall 30. As described in the above, the side walls 30 are for preventing the water 1 of the inlet 10 of the underground reservoir 20 from spilling over.

The horizontal planes 211 and the vertical planes 212 are inclined from the flow portion 100 to the drop portion 300. Also, the horizontal planes 211 and the vertical planes 212 form the step shape at the end of the flow portion 100. Therefore, the vortex generates in the water 1 when the water 1 flows into the drop portion 300 from the flow portion 100. Thus, even in the low flux, the energy of the flow can stably dissipate and a discharging efficiency can be maintained.

The drop portion 300 has a cylinder shape to generate the vortex in the water 1 flowing through the multiple-stage boards 210 of the inlet portion 200. Also, the drop portion 300 may include a spiral protrusion 310 having a spiral shape to maintain the vortex in the water 1 of the drop portion 300 and in the water 1 inflowing into the underground reservoir 20 coupled to the drop portion 30. By the spiral protrusion 310 formed at the drop portion 300, the vortex is generated in the water 1 inflows into the drop portion 300 from the inlet portion 200, and the vortex is generated or maintained in the water 1 of a lower portion of the drop portion 300. And thus, the water 1 can inflow into the underground reservoir 20 with the vortex. Also, the spiral protrusion 310 can act an auxiliary device for generating the vortex at the inlet portion 200.

For example, if the drop portion 300 does not include the spiral protrusion 310 for generating the vortex, the vortex does not generate when the flux of the water 1 inflowing through the inlet portion 200 is high or large, and thus, the structure may be damaged or broken by the flow energy of the water 1. On the other hand, in the present invention, the drop portion 300 includes the spiral protrusion 310 so that the vortex can generate even when the flux is large. Accordingly, by generating the vortex, the water 1 can be stably transferred to the underground reservoir 20 coupled drop portion 300 under the ground.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An inlet of an underground reservoir comprising:

a flow portion, wherein water flows;

a drop portion transporting the water to the underground reservoir from the flow portion; and an inlet portion having a multiple-stage structure to generate a vortex in the water to be transported to the drop portion, wherein the multiple-stage structure includes a plurality of multiple-stage boards, and wherein the plurality of multiple-stage boards include a first horizontal board, a second horizontal board and a first vertical board connecting the first horizontal board and the second horizontal board and downwardly extending from the first horizontal board to be perpendicular to the second horizontal board, thereby forming a step, and wherein the plurality of the multiple-stage boards are inclined from the flow portion to the drop portion, are parallel to the direction of the water flow thereon, and converge adjacent to the drop portion.

2. The inlet of the underground reservoir according to claim 1, wherein the flow portion is located at a more elevated position than the drop portion so that the water flows to the drop portion.

3. The inlet of the underground reservoir according to claim 2, wherein the flow portion includes a plurality of protrusions at a bottom of the flow portion to control a flow velocity of the water.

4. The inlet of the underground reservoir according to claim 1, wherein the drop portion has a cylinder shape to generate a vortex flow in the water inflowing through the multiple-stage boards.

5. The inlet of the underground reservoir according to claim 4, wherein the drop portion further includes a spiral protrusion having a spiral shape to maintain the vortex of the water when the water flows into the underground reservoir.

* * * * *